United States Patent [19]
Brockway et al.
[11] 4,244,755
[45] Jan. 13, 1981

[54] PROCESS FOR STABILIZING METALLIC CATHODE RAY TUBE PARTS

[75] Inventors: Thomas A. Brockway, Savona; Paul R. Grzesik, Painted Post; Lawrence B. Hausheer, Corning, all of N.Y.

[73] Assignee: Corning Glass Works, Corning, N.Y.

[21] Appl. No.: 77,571

[22] Filed: Sep. 21, 1979

[51] Int. Cl.³ ..... C21D 1/48
[52] U.S. Cl. ..... 148/16; 148/135
[58] Field of Search ..... 148/12 E, 12 EA, 16, 148/135, 136

[56] References Cited

U.S. PATENT DOCUMENTS

| | | | |
|---|---|---|---|
| 3,004,182 | 10/1961 | Pfaender | 313/64 |
| 3,021,643 | 2/1962 | Blanding et al. | 49/1 |
| 3,228,809 | 1/1966 | Berghaus et al. | 148/16 |
| 3,333,134 | 7/1967 | Demmy | 313/85 |
| 3,853,637 | 12/1974 | Gray et al. | 148/16 |
| 3,972,513 | 8/1976 | Mobius et al. | 148/16 |
| 4,181,541 | 1/1980 | LeFrancois | 148/16 |

*Primary Examiner*—L. Dewayne Rutledge
*Assistant Examiner*—John P. Sheehan
*Attorney, Agent, or Firm*—Kees van der Sterre; Clinton S. Janes, Jr.

[57] ABSTRACT

Stainless steel articles such as support pins for color television tube shadow mask assemblies are rendered resistant to the formation of surface nodules promoting tube breakage by processing through a vacuum-firing heat treatment prior to use.

8 Claims, No Drawings

PROCESS FOR STABILIZING METALLIC CATHODE RAY TUBE PARTS

BACKGROUND OF THE INVENTION

The present invention is in the field of cathode ray tube manufacture and specifically relates to the processing of metallic components for color television tubes, such as the mounting studs used to support internal elements of the tube.

Conventional color television picture tubes include an internal metal assembly known as a shadow mask, normally attached to the glass faceplate of the tube in proximity to the phosphor screen. By means of apertures therein, this shadow mask defines the positions at which electrons may impinge upon the phosphor screen.

Although many schemes for supporting the shadow mask at an appropriate position within these tubes have been proposed, the present method of choice involves the use of metal supporting elements, commonly referred to as studs or pins, pressed into the skirt or sidewall of the glass faceplate during the faceplate manufacturing process, to which the shadow mask components are subsequently attached as the tube is made. These pins are fabricated from steel, typically a stainless steel such as titanium-stabilized No. 430 stainless steel, which closely matches the thermal expansion coefficient of the glass faceplate. Expansion matching is necessary so that the pin/glass composite is not subjected to undue thermal stresses as the faceplate is exposed to subsequent temperature excursions involved in the manufacture and subsequent use of the tube. U.S. Pat. Nos. 3,004,182 and 3,333,134 show examples of tube configurations incorporating metal pins, while U.S. Pat. No. 3,021,643 describes methods and apparatus by which metal pins may be pressed into the glass skirt portion of a television picture tube faceplate.

Although the thermal expansion coefficient of the glass making up the faceplate is closely controlled during manufacture, so that problems relating to high stress at the pin insertion locations on the faceplate would not be expected, it has been found that a significant level of faceplate breakage initiating at these locations is encountered during subsequent high-temperature faceplate and tube processing operations. This problem has now been traced to a pin surface deterioration phenomenon, occurring prior to insertion of the pin into the faceplates, wherein highly localized regions of high thermal expansion are generated on the surfaces of the pins.

It is a principal object of the present invention to provide a solution to this deterioration problem, such that pins can be provided which significantly reduce the incidence of faceplate thermal stress breakage during the television tube manufacturing process.

Other objects and advantages of the invention will become apparent from the following description thereof.

SUMMARY OF THE INVENTION

The deterioration problem giving rise to a high rate of thermal breakage during tube manufacture is manifested at the time the stainless steel pins to be joined to the tube faceplate are pre-heated for pressing into the faceplate skirt, and involves the growth of surface nodules on the pins at preheating temperatures in the 1000°-1300° C. range. The nodules are believed to form at iron-rich locations on the pin surfaces, and apparently exhibit a higher thermal expansion coefficient than either the surrounding stainless steel or the glass. They therefore act as stress concentration points or stress risers which initiate glass fracture during subsequent heating or cooling of the faceplate or tube.

We have found that the tendency for such stainless steel to exhibit nodule growth on heating can be significantly reduced if the pins are vacuum-fired prior to use. Thus the present invention includes a process for improving the resistance of stainless steel pins or other stainless steel articles to surface nodule formation on heating in air, which process comprises vacuum-firing the articles at a temperature and for a time at least sufficient to reduce the nodule formation potential of the surfaces thereof. The effectiveness of vacuum-firing to reduce this potential is both time and temperature dependent, with higher temperatures and longer times being more effective for the purpose. Generally, heating temperatures of at least about 500° C. and heating times of at least about 5 minutes are employed to obtain useful improvements in the metal properties.

We have generally observed nodule formation on the surfaces of pins which have been previously surface-oxidized to provide a chromium oxide-containing surface layer thereon, said layer being advantageous for pin/glass bonding. However, processes may be envisioned wherein nodule formation on non-oxidized stainless steel surfaces could occur, so that the invention is not necessarily limited to the treatment of chromium oxide-surfaced stainless steel alone.

The advantages attending the use of the described process are substantial, in that stainless steel pin lots received from suppliers which would normally be unsuitable for use because of high nodule-forming potential may be vacuum-fired and thus converted to a highly nodule-resistant form. The incidence of glass faceplate breakage attributable to pin stress which is encountered in faceplate or tube manufacturing processes can thus be substantially reduced or eliminated.

DETAILED DESCRIPTION

For the purpose of the present description the term nodule forming potential as applied to a stainless steel surface refers to the level of nodule formation on that surface as the stainless steel is heated to an elevated temperature in air, and can be determined by subjecting the stainless steel article to a standard nodule test comprising heating the article in air to a temperature of approximately 1200° C. and maintaining the element at that temperature for five minutes. Depending upon the nodule forming potential of the metal surface, no nodules may be observed, or nodules ranging in size from about 0.002-0.020" in diameter and in nodule populations ranging as high as 200 nodules per pin may be observed.

The effectiveness of the present process for reducing nodule forming potential is not fully understood, although nodule formation appears to occur primarily at iron-rich or chrome-depleted surface regions of chromium oxide-containing stainless steel surfaces, and is apparently accelerated by the presence of atmospheric water during heating. However, it is believed that the process somehow affects the chemistry or structure of the metal surface, perhaps by removing surface $H_2O$ therefrom, in a manner which markedly reduces the rate of nodule formation or growth thereon. In any case, the process has been effectively used to convert lots of chromium oxide-surfaced stainless steel pins exhibiting very high nodule forming potential to a condition wherein exposure to the aforementioned standard nodule test produces no visually observable surface nodules thereon.

Regardless of the possible role of water in the nodule-forming process, it has been found that the beneficial effects of vacuum firing are best preserved by storing the fired pins under dry conditions until subsequently used. Preferably, the pins will be stored in a sealed container containing a desiccant immediately after firing, and kept therein until ready for use.

As previously indicated, the effectiveness of the process of the invention in reducing nodule formation is both time and temperature dependent. This means that at lower temperatures within the useful firing range, e.g., at 500° C., longer times are required to produce a useful reduction in nodule forming potential than are required at higher temperatures. While it is expected that firing temperatures up to the 1200° C. temperatures normally used for preheating stainless pins prior to the insertion thereof into a glass television faceplate could be used, such temperatures are not required for useful results, and therefore temperatures in the range of about 500°-900° C. are preferred.

Within this preferred temperature range, useful results can be obtained at 800° C. and above within firing intervals of 5 minutes or less, while at 500° C., firing temperatures of 20 minutes or more are typically employed. There is no maximum limit on the duration of the firing treatment, although for economic reasons times in excess of about 60 minutes are not preferred.

To further show the relationship between time and temperature in the firing process, the following Table reports the effect of various firing treatments on the nodule forming potential of a selected lot of stainless steel pins which had been identified as having a large potential for nodule formation on receipt from the supplier. The pins in this lot were composed of No. 430 (Ti) stainless steel, being about 0.375" in height, 0.500" in diameter, and incorporating a gray chromium oxide-containing surface layer thereon for the purpose of insuring good adherence to softened glass. These pins closely match commercial color television faceplate glass in thermal expansion. The room temperature thermal expansion mismatch in seals between such glass and pins of this stainless steel inserted therein is specified at 0 to 100 parts per million, with the steel being of slightly higher expansion.

All of these pins were nodule-free at the time of receipt from the supplier, but had been identified as having a nodule formation potential such that 100% of the pins from the lot were found to form nodules in populations exceeding about 100 nodules per pin following an exposure to the standard 5-minute, 1200° C. nodule test.

To reduce the nodule forming potential of these pins, various vacuum firing treatments were carried out at temperatures within the range of 500°-900° C. for times in the range of about 5-60 minutes, with groups of 12-25 pins being selected for each of the treatments. Following the treatments, the pins were tested for nodule characteristics by exposure to the standard 1200° C. nodule test, and the effect of the test on the surface characteristics of the pins was recorded. The relative success of each test was evaluated by determining the percentage of the treated pins which exhibited nodules after testing (given by the percentage values in the Table), and by the average number of nodules per pin (n/p), given as numeric values in the Table.

TABLE

| Vacuum-Firing Treatments | | | | | |
|---|---|---|---|---|---|
| Firing Time | Firing Temperature (° C.) | | | | |
| (minutes) | 500° C. | 600° C. | 700° C. | 800° C. | 900° C. |
| 5 min | 100%<br>341 n/p | 83%<br>54 n/p | 50%<br>29 n/p | — | — |
| 10 min | — | — | 36%<br>4 n/p | — | — |
| 20 min | 100%<br>44 n/p | 67%<br>17 n/p | 30%*<br>11 n/p | 33%<br>6 n/p | 4%*<br>1 n/p |
| 60 min | 50%<br>8 n/p | 33%<br>5 n/p | 17%<br>2 n/p | — | — |

*Average of two tests

Although not reported in the above Table, each of the treatments which was found to be effective in reducing the number of nodules produced during the nodule test also reduced the size of the nodules formed on testing, with the extent of size reduction being approximately proportional to the extent of nodule formation.

All of the tests reported in the Table were conducted under a vacuum of about $2\times10^{-3}$ torr. Other vacuum levels have also been used, and we have learned that, generally, improved results are obtained where higher vacuum levels (lower pressures) are used during a selected firing treatment. Thus the level of vacuum applied, while not critical to the results obtained, can also be adjusted to control the results of the vacuum firing to meet the demands of a particular need.

Of course the examples given in the foregoing Table are merely illustrative of vacuum-firing conditions which could be employed to reduce the nodule forming potential of stainless steel articles in accordance with the invention hereinabove described. Similarly, while those examples are directed to the treatment of Type 430 (Ti) stainless steel pins, it is anticipated that the described process would have equivalent application to other stainless steels of the 400-Series Type (for example, Nos. 406, 410, 416, 420, 422, 444, 446 or any other of the 13-17% Cr-Fe stainless steel alloys), to the extent such steels exhibit nodule formation at elevated temperatures as hereinabove described. It is therefore believed that such variations upon the examples specifically set forth are within the scope of the invention as defined by the appended claims.

We claim:

1. A process for improving the resistance of a stainless steel article to surface nodule formation on exposure to air at high temperatures which comprises the step of vacuumfiring the article at a temperature of at least about 500° C. for a time at least sufficient to reduce the nodule forming potential thereof.

2. A process in accordance with claim 1 wherein the stainless steel article comprises a chromium oxide-containing surface layer.

3. A process in accordance with claim 2 wherein the article is vacuum-fired at a temperature in the range of about 500°-1200° C.

4. A process in accordance with claim 3 wherein the article is vacuum-fired at a temperature in the range of about 500°-900° C.

5. A process in accordance with claim 3 wherein the article is vacuum-fired for a time in the range of about 5-60 minutes.

6. A process in accordance with claim 2 wherein the stainless steel article is composed of a 400-Series stainless steel.

7. A process in accordance with claim 6 wherein the article is composed of No. 430 (Ti) stainless steel.

8. A process in accordance with claim 7 wherein the article is a stainless steel shadow mask support pin for a color television picture tube.

* * * * *